US009024773B2

(12) United States Patent
Shilts et al.

(10) Patent No.: US 9,024,773 B2
(45) Date of Patent: May 5, 2015

(54) ANTI-LIGATIVE BED LINEN SYSTEM

(71) Applicants: Steven J. Shilts, San Diego, CA (US); Brook Hjelm, Ramona, CA (US)

(72) Inventors: Steven J. Shilts, San Diego, CA (US); Brook Hjelm, Ramona, CA (US)

( * ) Notice: Subject to any disclaimer, the term of this patent is extended or adjusted under 35 U.S.C. 154(b) by 0 days.

(21) Appl. No.: 13/834,626

(22) Filed: Mar. 15, 2013

(65) Prior Publication Data

US 2013/0278431 A1 Oct. 24, 2013

Related U.S. Application Data

(60) Provisional application No. 61/637,814, filed on Apr. 24, 2012, provisional application No. 61/637,836, filed on Apr. 24, 2012, provisional application No. 61/647,504, filed on May 15, 2012.

(51) Int. Cl.

| | |
|---|---|
| ***G08B 21/00*** | (2006.01) |
| ***A47G 9/02*** | (2006.01) |
| ***A47G 9/10*** | (2006.01) |

(52) U.S. Cl.
CPC ... *A47G 9/02* (2013.01); *A47G 9/10* (2013.01)

(58) Field of Classification Search
USPC ..... 340/686.6, 506, 540, 573.1; 5/482, 498
See application file for complete search history.

(56) References Cited

U.S. PATENT DOCUMENTS

| | | | | |
|---|---|---|---|---|
| 4,266,308 | A * | 5/1981 | Shatz | 5/494 |
| 4,388,738 | A * | 6/1983 | Wagner | 5/421 |
| 4,411,034 | A | 10/1983 | Williams | |
| 4,614,939 | A | 9/1986 | Wang | |
| 4,924,543 | A * | 5/1990 | Hoss et al. | 5/484 |
| 5,941,186 | A | 8/1999 | Argentino | |
| 6,108,836 | A | 8/2000 | Keene, III | |
| 7,810,184 | B2 * | 10/2010 | McCollum | 5/500 |
| 8,011,041 | B2 * | 9/2011 | Hann | 5/652.1 |
| 2001/0032358 | A1 * | 10/2001 | Talley-Williams | 5/482 |
| 2008/0316027 | A1 | 12/2008 | Lefferson | |
| 2010/0306920 | A1 * | 12/2010 | Balasundharam | 5/496 |

* cited by examiner

*Primary Examiner* — Phung Nguyen
(74) *Attorney, Agent, or Firm* — Mandy T. Garrels

(57) ABSTRACT

An anti-ligative bed linen system includes one-piece bedding having a top blanket attached to the base of a bottom cover to fit on a mattress. The bed linen includes quilted material that resists tearing or vandalism. The features of being one-piece, quilted, and tear resistant creates a bed linen that is difficult to contrive a hanging device from. Rolling up the quilted material makes a thicker lanyard as compared to a sheet or thin blanket that hospitals typically use. The thicker the lanyard the less lethal it is. Built into the structure are features that allow another bed linen set to be installed over an existing set so the user can use multiple blankets if desired. Another feature includes an alarm system that warns when the bed linen has been removed from the mattress. A washable foldable quilted pillow provides safe comfort and avoids the dangers of using pillowcases.

28 Claims, 12 Drawing Sheets

ANTI-LIGATIVE BED LINEN SYSTEM

CROSS-REFERENCE TO RELATED APPLICATIONS

This application claims the benefit of U.S. Provisional Patent Applications 61/637,814 filed on Apr. 24, 2012; 61/637,836 filed on Apr. 24, 2012; and 61/647,504 filed on May 15, 2012, and they are incorporated herein by reference in their entirety.

STATEMENT REGARDING FEDERALLY SPONSORED RESEARCH AND DEVELOPMENT

Not Applicable.

FIELD OF THE INVENTION

This invention relates to bed linens and more particularly to therapeutic anti-ligative bed linens.

DISCUSSION OF RELATED ART

Annually, there are over 30,000 deaths due to suicide in the United States. More than 90 percent of people who commit suicide have a diagnosable mental disorder, most commonly a depressive disorder or a substance abuse disorder. Bedding and bed sheets are the number one item used to fashion a lanyard for hanging. Bedding and bed sheets are used in 53% of all inpatient suicide completions and attempts. Therefore, there is a need to provide an attractive and safe alternative to the standard bed linens and sheets that hospitals and institutions use. The focus areas would be psychiatric units or any institution that houses people with suicidal and self-harm behaviors or thoughts.

To reduce the ability to form a lanyard from bed linen, the bed linen should be difficult to remove from the bed, including the sheets and any blankets. Therefore, using a one-piece blanket and mattress cover would be safer as it would be more cumbersome to remove from a bed than individual sheets or blankets. Even better, the bed linens should incorporate an alarm to warn staff that bed linens are being removed. Also, pillow cases create additional suffocation risks and should not be provided to suicidal patients. Therefore, a bed linen system is needed that incorporates a washable pillow that avoids the need for a pillowcase.

U.S. Pat. No. 4,924,543 shows a bed linen sheet design that has an attached top sheet and bottom sheet the point of attachment between the two is at the foot of bed top edge. This patent does not address the issue of the danger of loose blankets and does not address how to safely provide blankets to a patient. In fact, the '543 design does not allow a separate top and bottom sheet set to be placed over an existing top and bottom sheet set.

Another approach, U.S. Pat. No. 7,810,184 shows the top and bottom sheet being attached at the side. This design could be problematic as the elderly or confused individual might try to exit the bed on the seamed side and create a fall hazard. The optimal design is for attachment towards the foot of the bed allowing ease of entry and exit from either side. The '184 design also does not allow for multiple sets to be fitted to the mattress and thus not providing the ability to meet different patients' needs for more warmth.

U.S. Pat. No. 6,108,836 shows a bed sheet top and bottom point of attachment at the bottom edge the inventor explains this feature allows the persons foot to extend pass the mattress, this would be an improvement over U.S. Pat. No. 4,924,543. However, U.S. Pat. No. 6,108,836 does not deal with the problem of placing multiple bed linens on one mattress and does not suggest any structures to make a bed linen layerable, especially a bed linen that incorporates a blanket.

Therefore, there is a need for a one-piece bed linen solution that is not easily removed, yet is layerable to address the warmth needs of different patients. Additionally, the bed linen should be made out of thicker, tear resistant fabrics, such as quilted materials, that are difficult to convert into a lethal lanyard. Also, a bed linen system is needed that alerts staff when a patient is attempting to remove the bed linen from a mattress. Furthermore, such a bed linen system would avoid using pillow cases that can be easily converted to deadly objects. Additionally, the bed linen system needs to be easily washed to be hygienic for numerous uses by numerous people. The present invention accomplishes these objectives.

SUMMARY OF THE INVENTION

The anti-ligative bed linen system provides structures for bed linens including pillows to prevent using them for suicide or bodily harm. The invention provides many benefits: ease of bed making, comfort, flexibility to safely have more than one blanket, and added aesthetic of the living environment. The bed linen system includes a bed line made from thicker material, such as quilted material. A one-piece design includes a cover portion fitted directly over the mattress and a blanket portion that covers a person in bed. The one-piece design has an increased degree of bulkiness, making it difficult to roll or fold. With the blanket connected to the mattress cover, the entire bed linen has to be removed to attempt using parts of it as a lanyard. In addition, the linen system may be equipped with an alarm system, which activates if the bedding is removed for tampering, thus triggering a response from hospital staff members.

The bed linen includes a structure that allows a main portion of the blanket to overhang the sides of the mattress easily. This natural drop is aesthetically appealing as well. The attribute of having the top blanket and bottom cover connected means the blanket will not come out loose during sleeping hours. When combined with not having to tuck the corners of sheets or blankets, the bed becomes easier to make. Less effort to make the bed has the potential for even depressed and unmotivated individuals to complete a bed making task.

The bed linen system includes a bi-fold pillow made from thicker fabrics, such as a quilted material. The bi-fold design compartmentalizes stuffing into smaller sections thereby stabilizing the pillow stuffing. The stuffing resists clumping, which can occur when laundering the pillow. The quilted pillow eliminates the asphyxiation hazard associated with vinyl pillows and eliminates the danger of a pillowcase being used as a ligature for suicide. In addition, the use of thicker fabrics and quilted fabric makes the bed linens tamper resistant and tear resistant.

There are a number of advantages of the structures of the anti-ligative bed linen system. The primary advantage is the elimination of safety hazards that are associated with standard bed linens and pillows. The system includes a one-piece bed linen that is not easily removed, yet is layerable to address the warmth needs of different patients. Additionally, the bed linen system is made out of thicker, tear resistant fabrics, such as quilted materials, that are difficult to convert into a lethal lanyard. The one-piece linen system eliminates the need for fitted sheets and blankets allowing staff and patients to manage an easier one-piece system. Also, the bed linen system includes an alarm system that alerts staff when a patient is attempting to remove the bed linen from a mattress.

The bed linen system eliminates using pillow cases that can be easily converted to deadly objects. Furthermore, since the washable pillow is flatter and the pillow stuffing resists clumping, it allows for multiple launderings and infection control. In addition, the bed linen system is structured for comfort and is aesthetically pleasing to patients (allowing potential color and design customization for patients), which improves the therapeutic environment for the patients. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
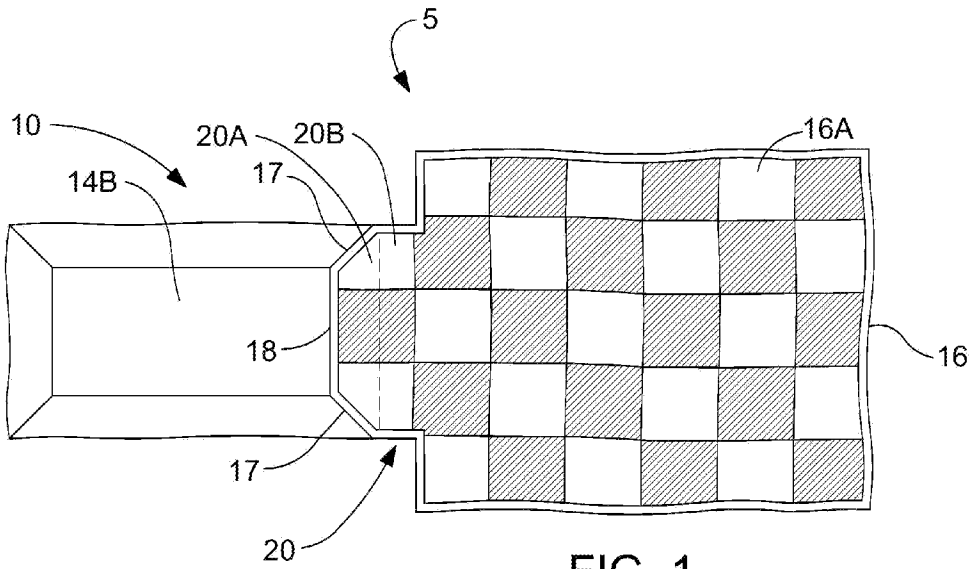
FIG. 1 is a top plan view of an anti-ligative bed linen topside.
Figures 10, 11:
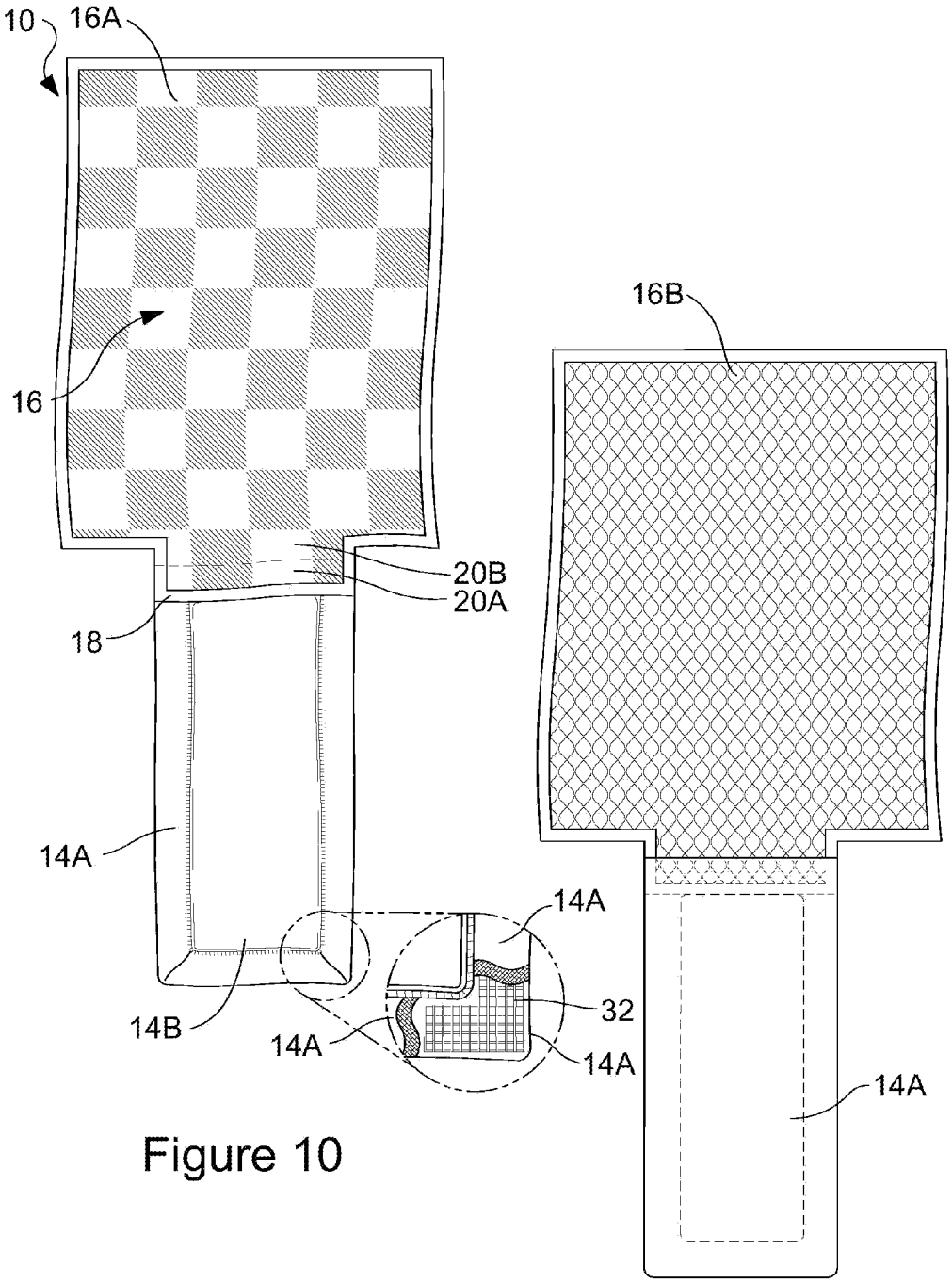
FIG. 10 is a top plan view of a bed linen with an enlarged cut-away view of sensor material in the cover.
FIG. 11 is a top plan view of an embodiment of a bed linen.
Figure 17:
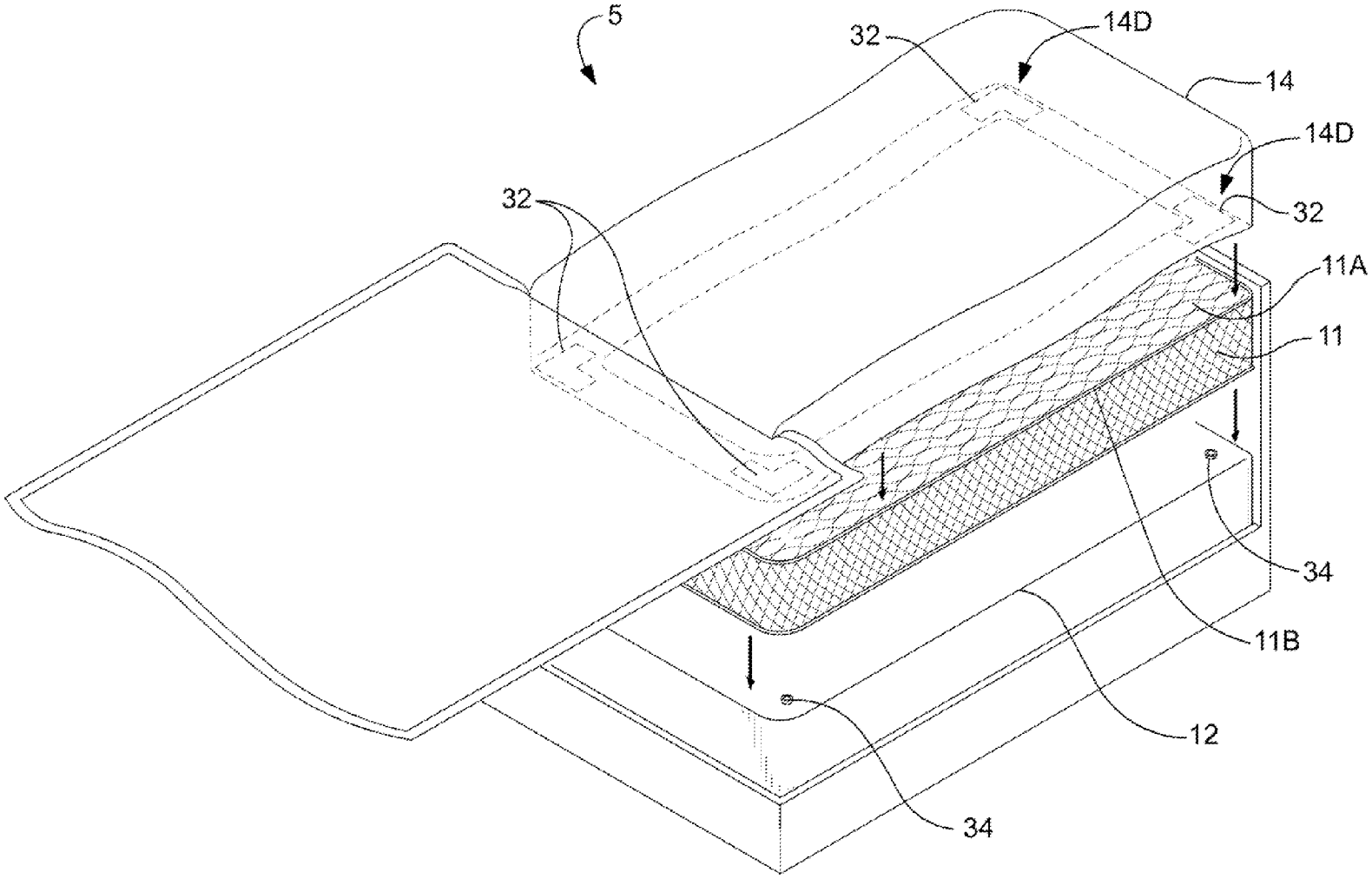
FIG. 17 is a perspective view of the anti-ligative bed linen system.

With respect to the drawings, the invention includes an anti-ligative bed linen system 5 for a mattress 11, as illustrated in FIG. 17. The bed linen system 5 includes a bed linen 10, in FIG. 1. In FIGS. 10 and 11, the bed linen 10 includes a blanket 16 having a top side 16A and a bottom side 16B that would face towards a person when in a bed. In FIG. 17, a cover 14 is configured to fit on the mattress 11. The cover 14 has an outside surface 14A and an inside surface 14B, as illustrated in FIGS. 10 and 11. The outside surface 14A would be towards a person and the inside surface 14B would be towards the mattress 11.

Figure 1A:
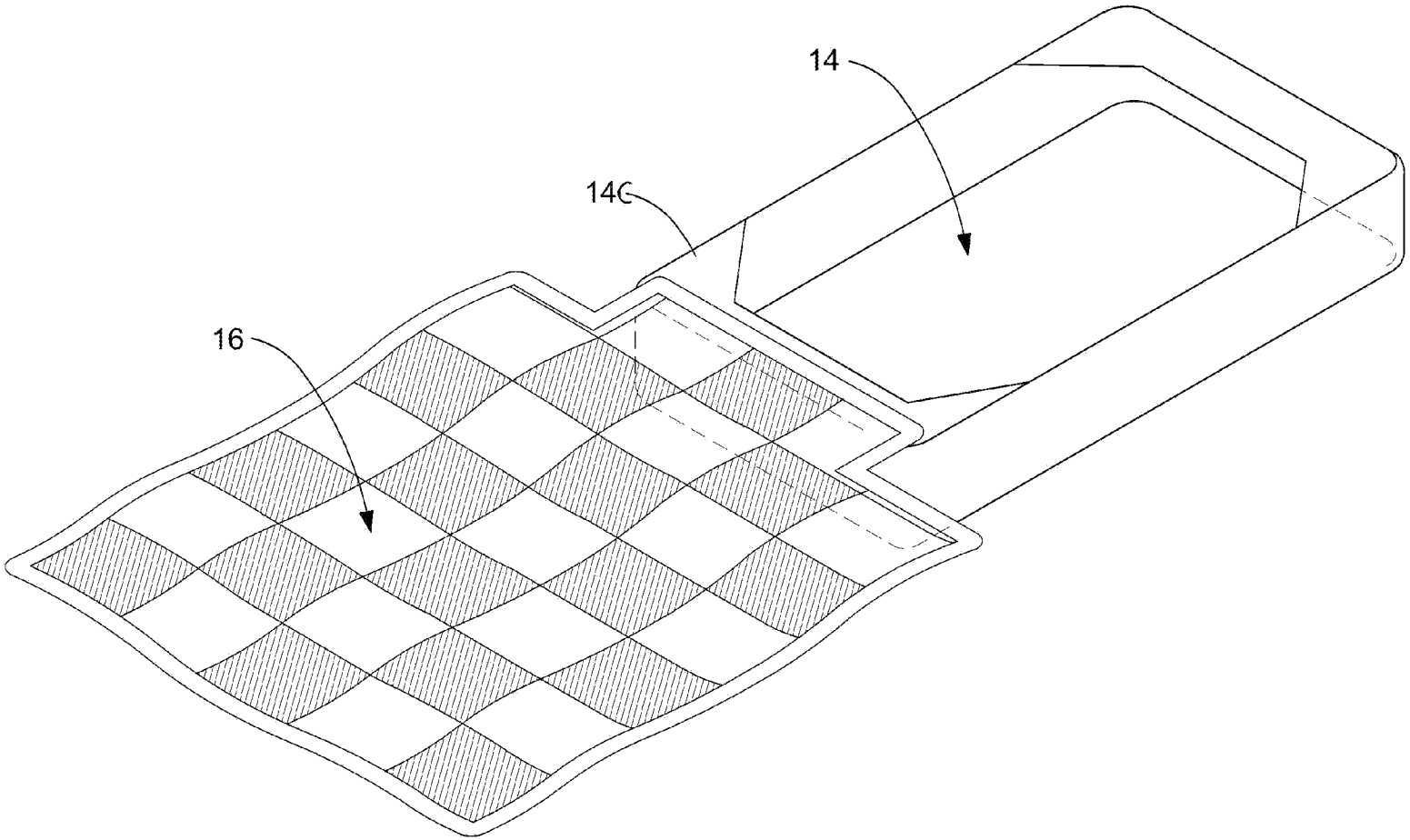
FIG. 1A is a perspective view of an embodiment of a mattress cover.
Figure 1B:
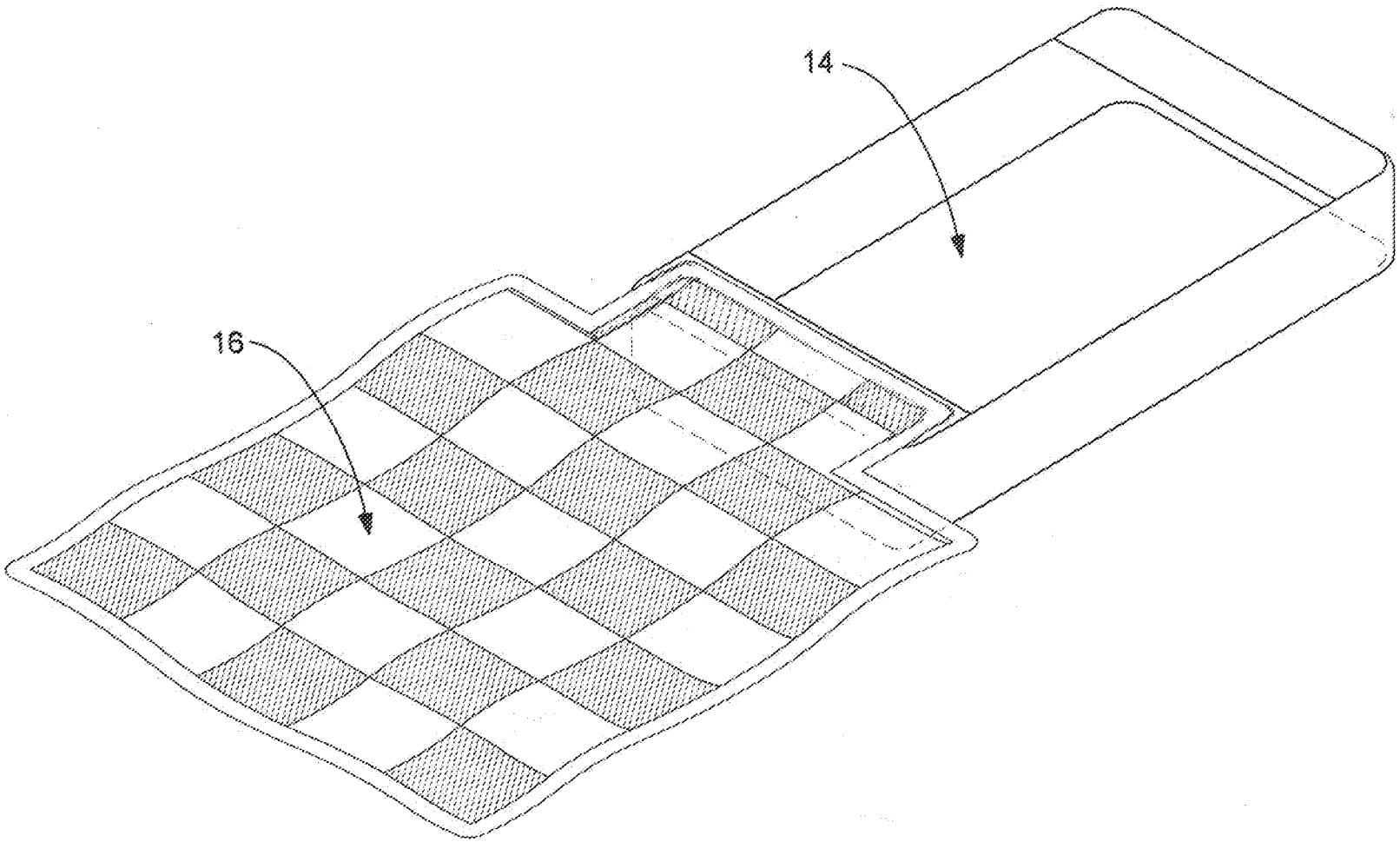
FIG. 1B is a perspective view of another embodiment of a mattress cover.
Figure 3:
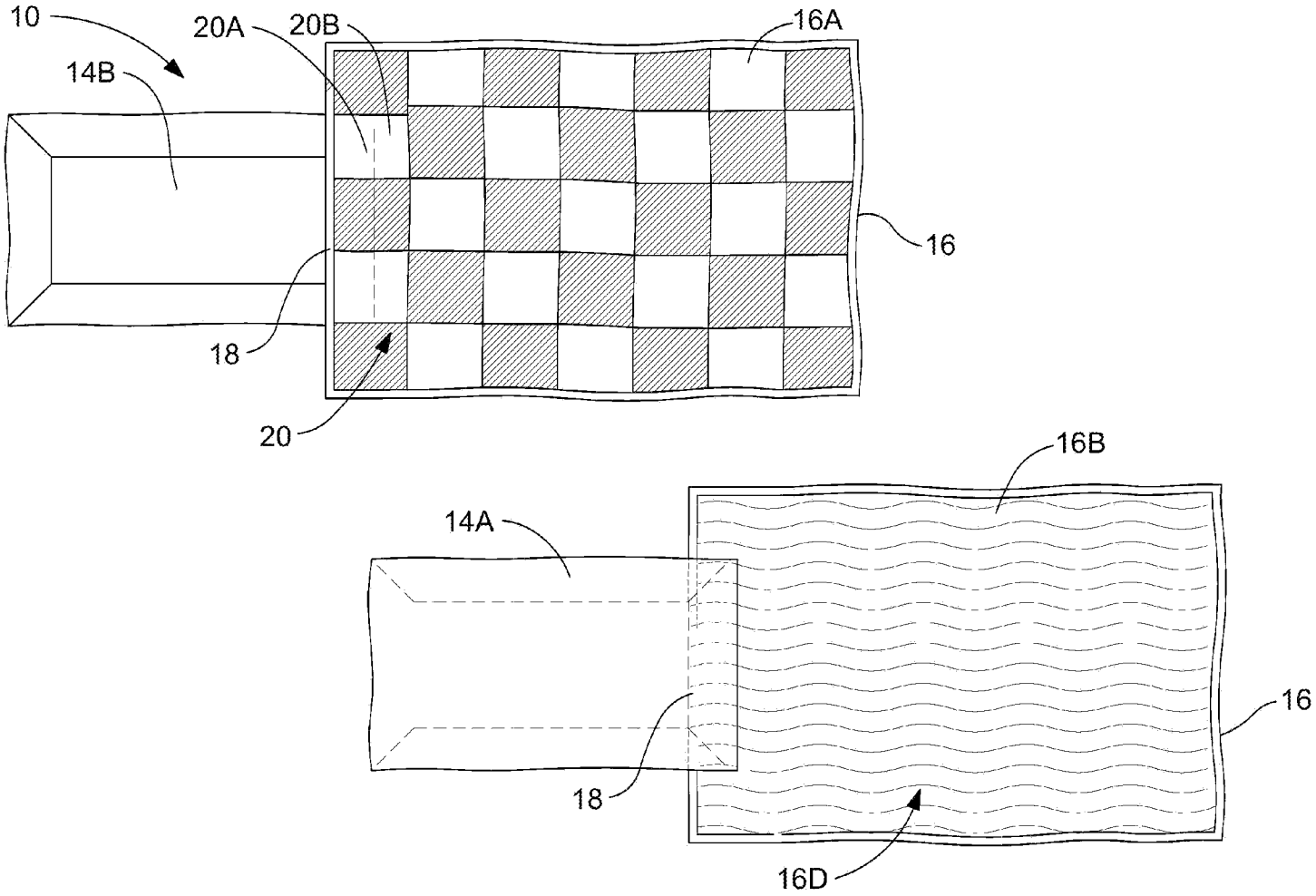
FIG. 3 is a top plan view of an embodiment of the bed linen.
Figure 4:
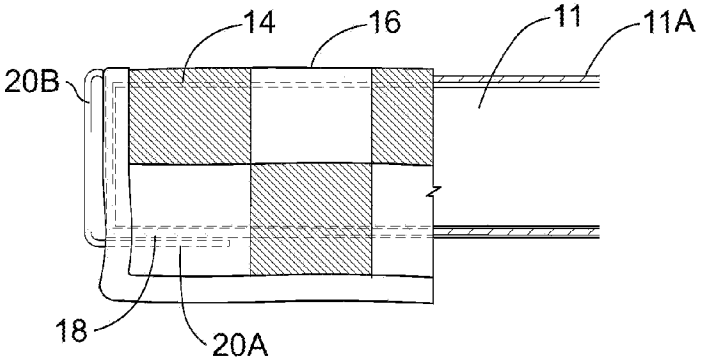
FIG. 4 is a partial side elevational view of the bed linen on a mattress.

In FIG. 3, a lower portion 16C of the bottom side 16B of the blanket 16 is secured to an end portion 14C of the outside surface 14A of the cover 14 creating a secured union 18 between the blanket 16 and cover 14. In a preferred embodiment, the end portion 14C wraps under the mattress 11, securely positioning the cover 14 onto the mattress 11. FIGS. 1A and 1B illustrate different embodiments of the end portion 14C. In a preferred embodiment, the cover 14 wraps under all sides of the mattress 11. In FIG. 4, the union 18 is configured to lie under the mattress 11 when the bed linen 10 is placed on the mattress 11. In one embodiment, the cover 14 wraps under the mattress 11 about six inches deep to better secure the cover 14 and so that the union 18 can be place farther under the mattress 11 to provide space for additional bed linens 10 to be added. In one embodiment, the union 18 is created with stitching, with the stitching running the width of union 18, though other securing methods could be used such as hard plastic rivets, or a combination of securing methods could be used. In FIG. 3, a main portion 16D of the blanket 16 is not secured to the cover 14 and is available to be used for warmth when the anti-ligative bed linen system 5 is placed on the mattress 11.

Figure 2:
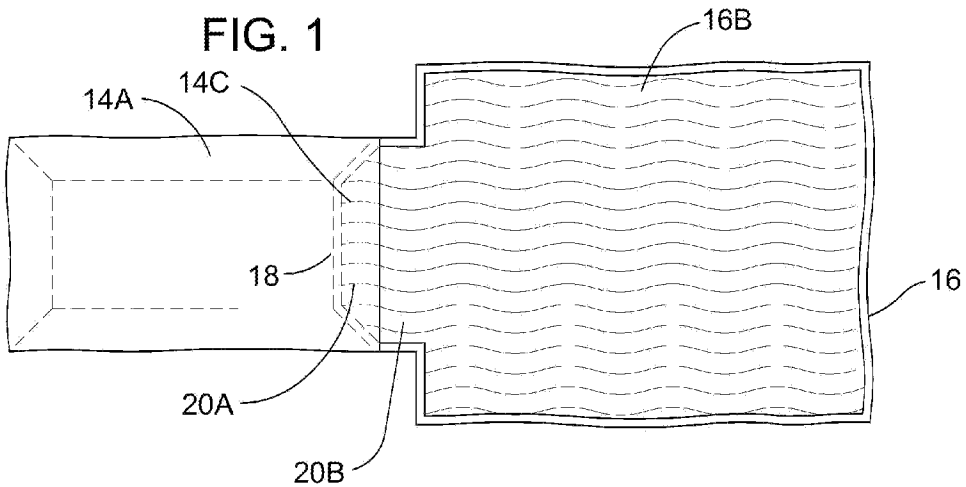
FIG. 2 is a top plan view of an anti-ligative bed linen bottom side.
Figure 5:
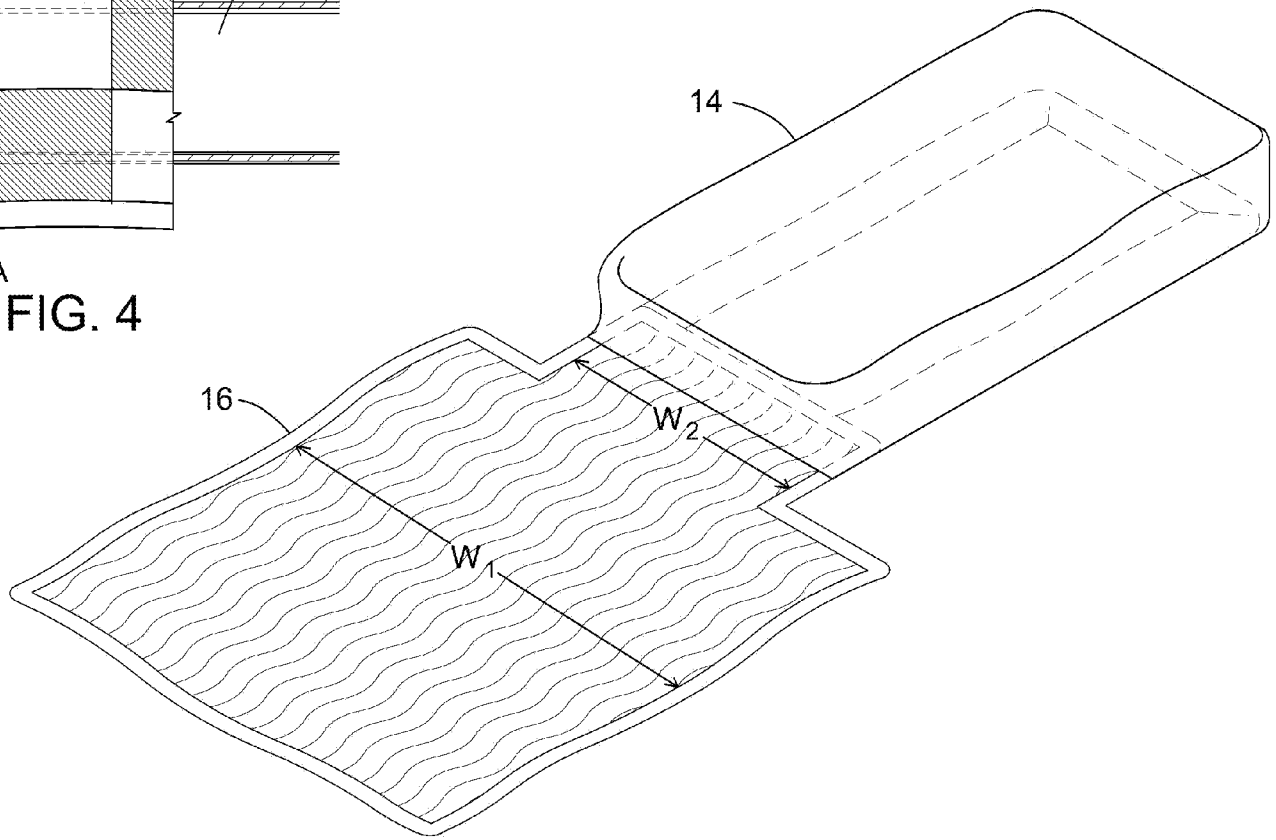
FIG. 5 is a perspective view of an extended flap.

In one embodiment, the lower portion 16C of the blanket 16 includes an extended flap 20 having a width $W_2$ narrower than the width $W_1$ of the main portion 16D of the blanket 16, as illustrated in FIG. 5. In a preferred embodiment the width $W_2$ of the extended flap 20 is approximately the same width as the cover 14 and the mattress 11. In FIG. 2, a lower part 20A of the extended flap 20 is secured via the bottom side 16B of the blanket 16 to the end portion 14C of the outside surface 14A of the cover 14 creating the secured union 18 between the blanket 16 and cover 14. In the embodiment in FIG. 1, the extended flap 20 has tapered edges 17 and the union 18 length is defined as between each taper 17 of the blanket 16. In one embodiment, the tapered edges 17 are not stitched to the cover 14. In FIGS. 2 and 4, an upper part 20B of the extended flap 20 is not secured to the cover 14 and extends approximately up to a top surface 11A of the mattress 11 when the bed linen 10 is placed on the mattress 11, allowing the main portion 16D of the blanket 16 to drape over side edges 11B of the mattress 11. The combined structure of the blanket 16 easily draping over the mattress 11 and being secured to the cover 14 simplifies the making of a bed by eliminating the need to tuck the corners of sheets or blankets. Less effort to make the bed facilitates even depressed and unmotivated persons to complete a bed making task, helping to improve self-respect and confidence.

In one embodiment, the bed linen 10 is made of a material having a thickness that hinders persons from rolling the bed linen 10 to use as a ligature to commit suicide. In another embodiment, the bed linen 10 is made of a material having a strength that hinders persons from tearing the bed linen 10 to use as a ligature to commit suicide. This bed linen system 5 is structured to eliminate the use of sheets and be used in place of sheets. Preferably, the bed linen 10 is made of a quilted material, with the quilting strengthening the material. The material is preferably a washable durable material, such as a cotton polyester blend, but other suitable materials with similar properties may be used. A quilted cotton material adds to a person's comfort and the quilted bed linen 10 provides aesthetic and therapeutic value as well. Threads used for the quilting are preferably heavy polyester threads to make the bed linen system 5 tough and resistant to tearing.

Figure 6:
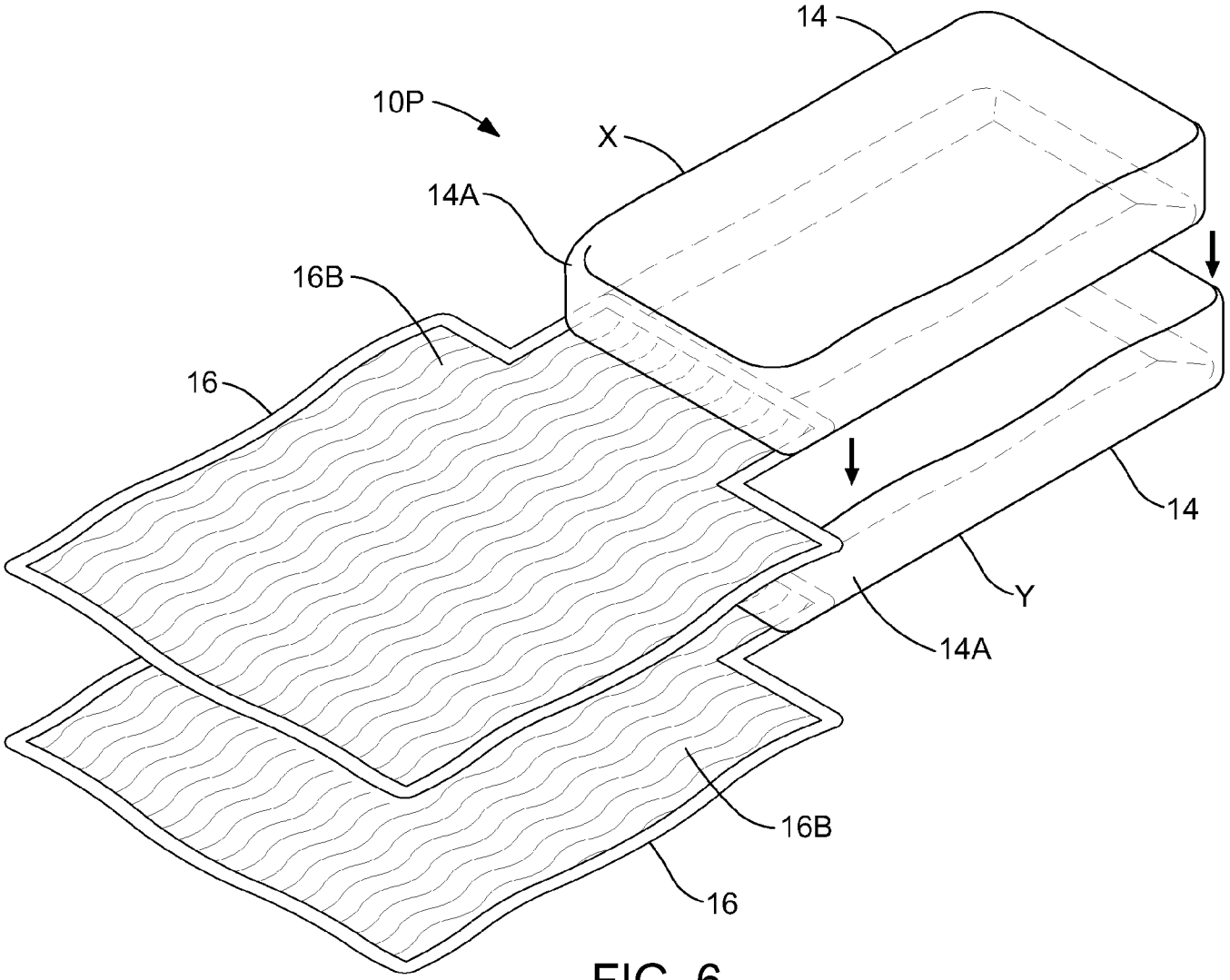
FIG. 6 is a perspective view of a second bed linen X being placed over a first bed linen Y.
Figure 8:
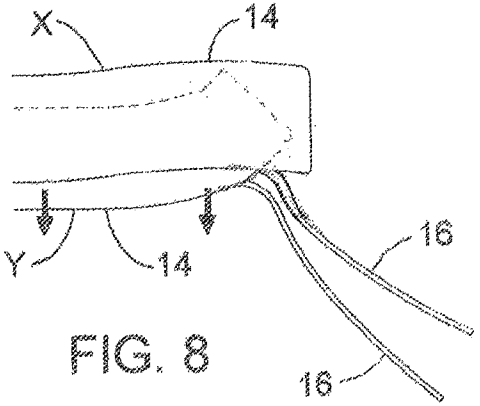
FIG. 8 is a side elevational view of a second bed linen being placed over a first bed linen.
Figure 9:
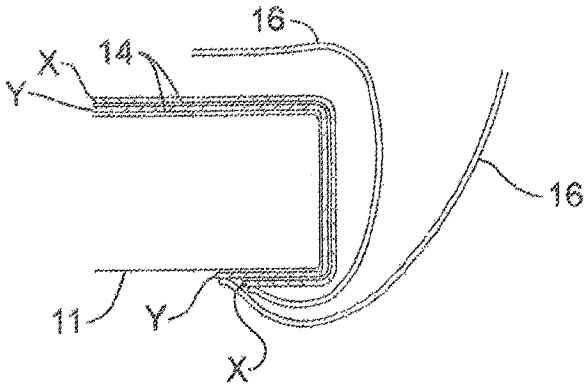
FIG. 9 is a cut-away view side elevational view of a first bed linen placed over a second bed linen.
Figure 7:
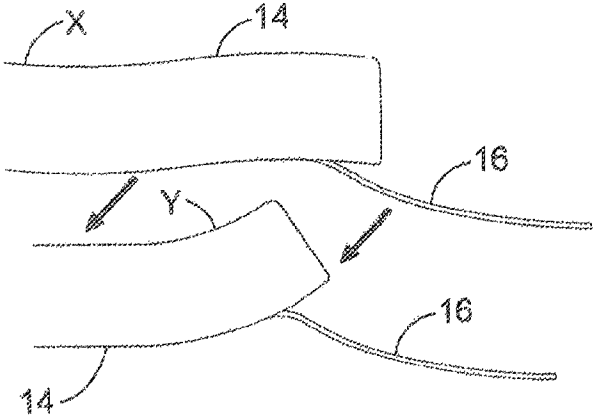
FIG. 7 is a side elevational view of a second bed linen ready to be placed over a first bed linen.

In one embodiment in FIG. 6, the union 18 is configured to lie under the mattress 11 allowing a plurality 10P of bed linens 10 to be placed onto the mattress 11. This embodiment provides the ability to safely place more than one bed linen 10 on the mattress 11 to provide additional warmth from additional blankets 16. In FIGS. 7 and 17, a bed linen Y is first placed on a mattress 11. Next, in FIG. 8, bed linen X is positioned over bed linen Y. This results with bed linens X and Y being placed together on a mattress, as illustrated in FIG. 9. Bed linen X's blanket 16 and bed linen Y's blanket 16 are available to be positioned on the top of the mattress 11 as desired.

Figure 12:
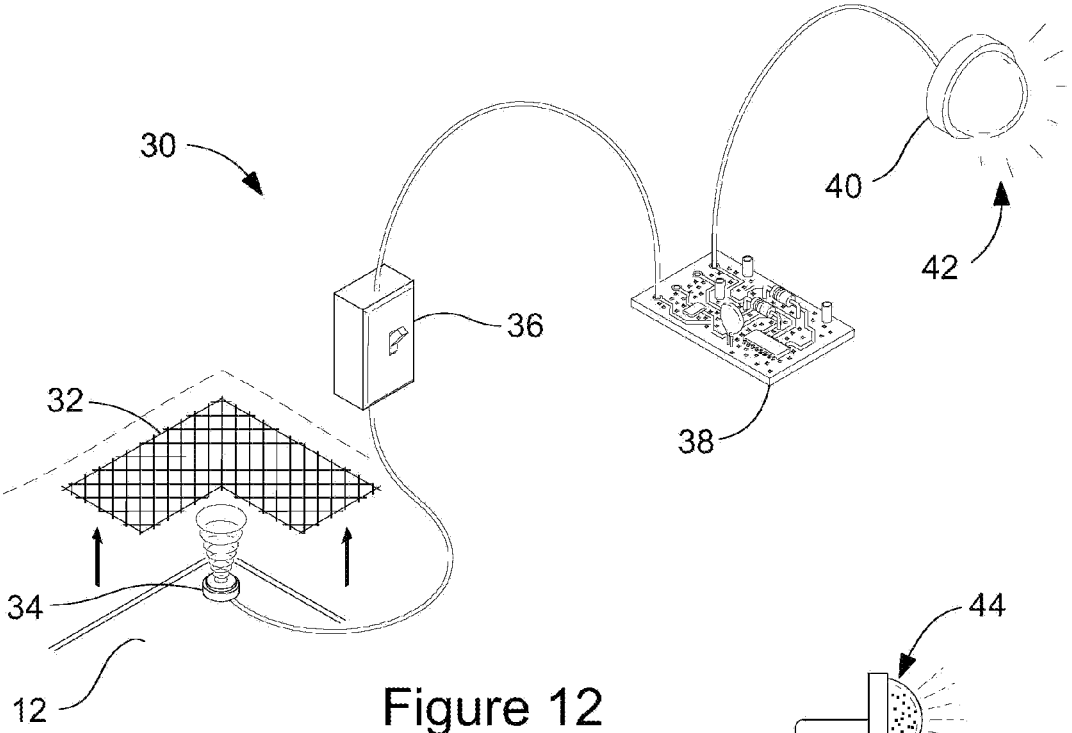
FIG. 12 is a perspective view of an alarm system being actuated.
Figure 13:
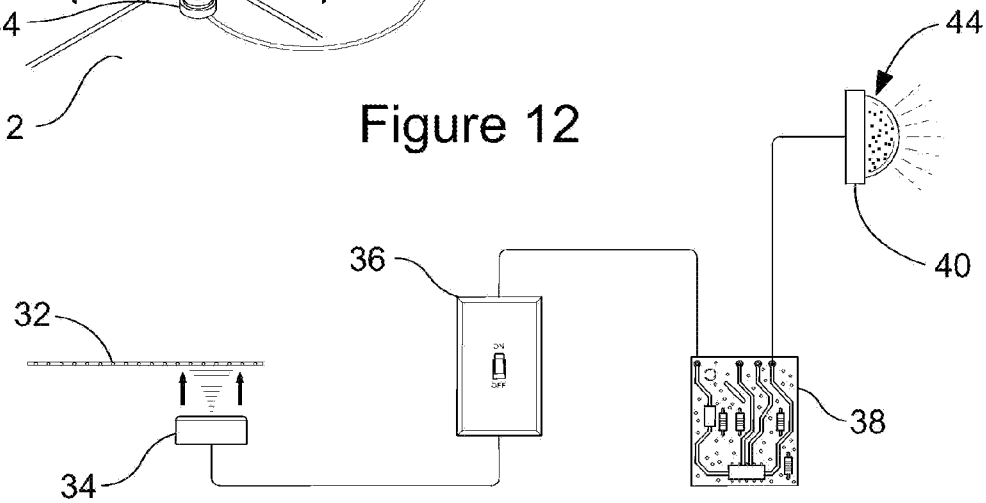
FIG. 13 is a schematic view of an alarm system being actuated.
Figure 14:
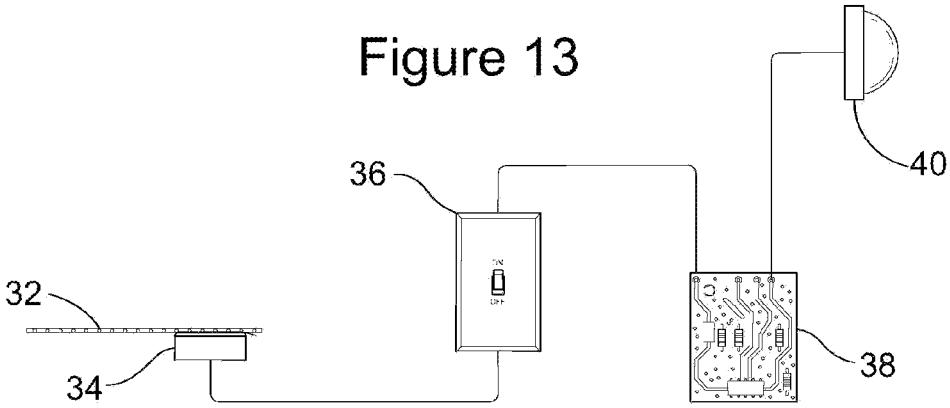
FIG. 14 is a schematic view of an alarm system in a ready state.
Figure 15:
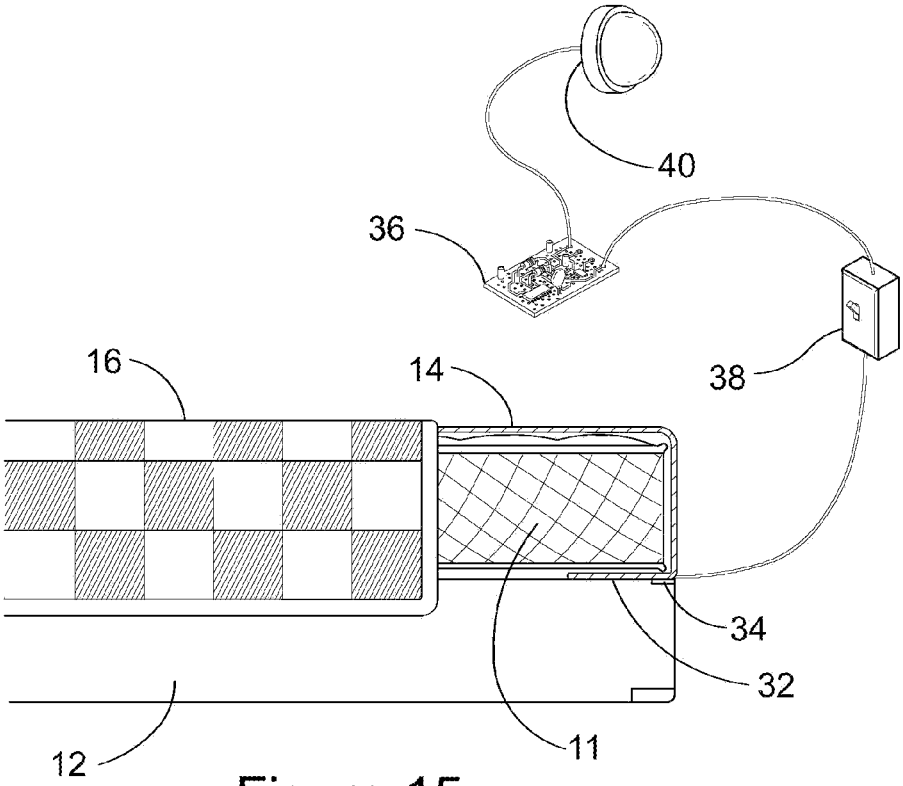
FIG. 15 is a side perspective view of the alarm system in a ready state.
Figure 16:
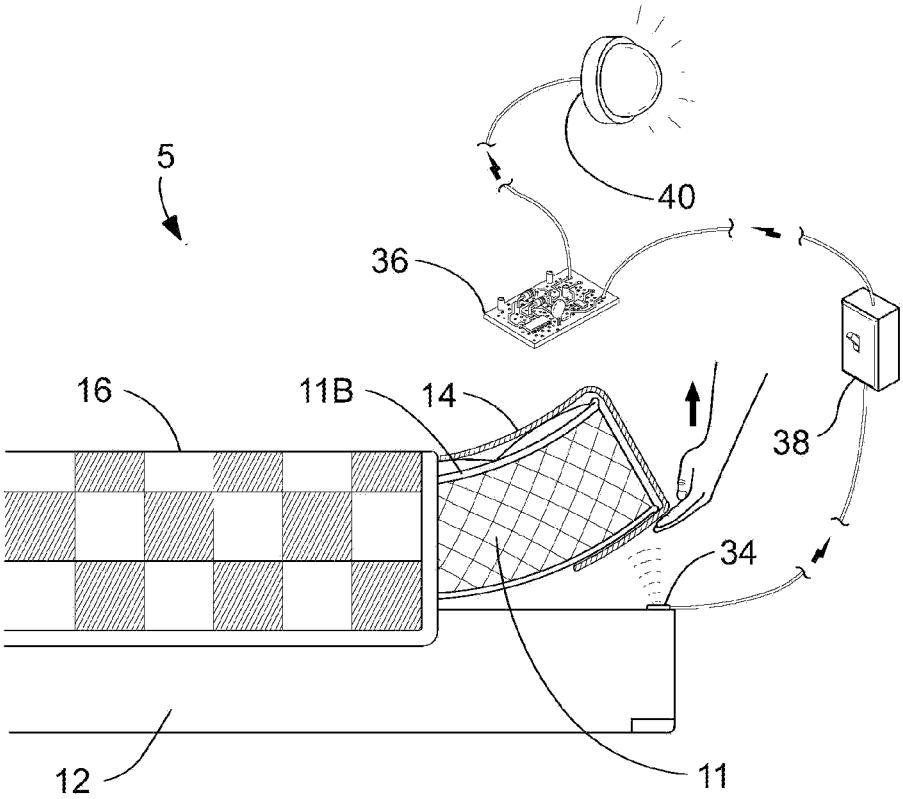
FIG. 16 is a side perspective view of the alarm system being actuated.

One embodiment of the bed linen system 5 further includes an alarm system 30 (FIG. 12) that warns when the bed linen 10 has been removed from the mattress 11. In an embodiment in FIG. 17, the alarm system 30 includes a sensor material 32 incorporated into at least one section 14D of the cover 14. The sensor material 32 may be sewed into the cover 14. In FIGS. 15 and 16, a sensor is placed proximate the mattress 11 and senses when the sensor material 32 is in close proximity to the sensor 34. In FIGS. 13 and 14, a circuit 38 is in communication with the sensor 34. Also in FIGS. 13 and 14, an alarm 40 is in communication with the circuit 38. As illustrated in FIGS. 12 and 13, the circuit 38 actuates the alarm 40 when the sensor 34 indicates to the circuit 38 that the sensor material 32 is no longer in close proximity to the sensor 34, indicating the bed linen 10 is being removed from the mattress 11. The term "in communication with" includes both wired and wireless forms of communication, such as traditional metal wiring or wireless communications suitable for use with alarm systems. Any use of wires needs to be securely incorporated to avoid being used as a lanyard as well. As the alarm system 30 is used in close proximity to a sleeping person, care must be taken that the alarm system 30 possesses no risk of fire.

One embodiment of the alarm system 30 further includes a setting switch 36 (FIG. 12) in communication with the circuit 38. The setting switch 36 activates and deactivates the alarm system 30. In one embodiment, the alarm 40 includes a visual warning indicator 42, as seen in FIG. 12. In another embodiment in FIG. 13, the alarm 40 includes an audial warning indicator 44. The alarm 40 may include both the visual and audial warning indicators 42,44, to better alert the appropriate people that the bed linen 10 is being removed from the mattress 11 and a person may be attempting to harm themself.

In one embodiment in FIG. 17, the sensor material 32 in each section 14D of the cover 14 is configured to be located under the mattress 11 when the cover 14 is placed on the mattress 11. In another embodiment in FIG. 17, the sensor 34 is attached to a bed platform 12 located underneath the mattress 11. In one embodiment, the sensor material 32 is a metalized material, such as a soft flexible metal mesh type material that can be reliably detected by the sensor 34, though other suitable materials may be used in conjunction with the sensor 34. The sensor material 32 needs to be washable and not create a risk of cutting through the bed linen 10.

Figure 18A:
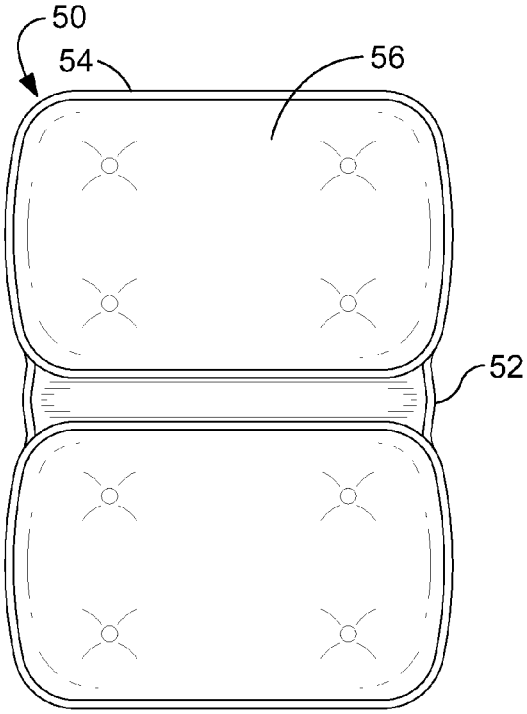
FIG. 18A is a top plan view of a bi-fold pillow in an unfolded state.
Figure 18B:
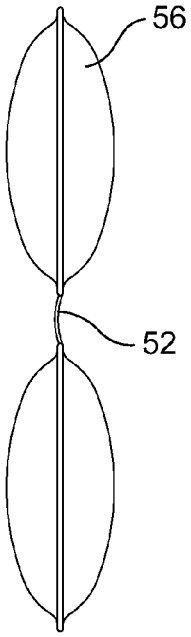
FIG. 18B is a side elevational view of a bi-fold pillow.
Figure 19:
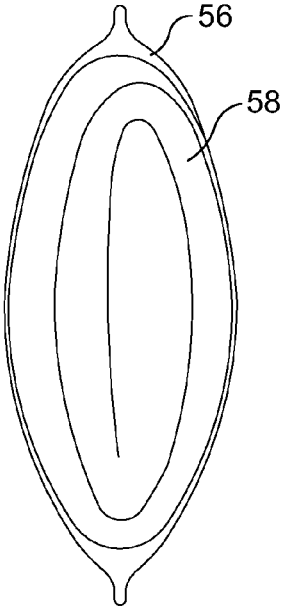
FIG. 19 is a cross-sectional view of a pillow half, illustrating lofty stuffing.
Figure 18C:
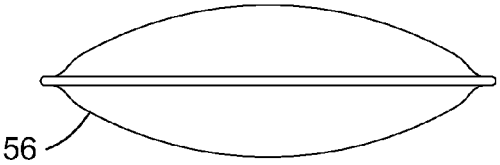
FIG. 18C is a front elevational view of a bi-fold pillow.
Figure 20:
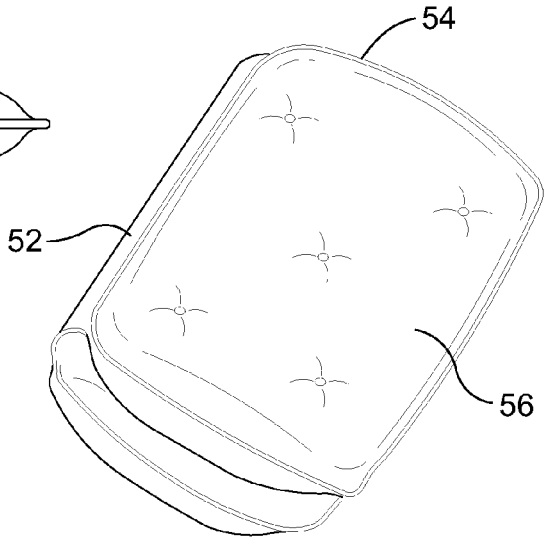
FIG. 20 is a perspective view of a bi-fold pillow in a folded state.

In FIG. 18A, another embodiment of the bed linen system 5 further includes a washable bi-fold quilted pillow 50. As the entire pillow 50 is washable, the pillow 50 does not need a pillowcase. Additionally, as the pillow 50 is quilted, the pillow 50 is difficult to tear open to use for suffocation. The bi-fold pillow 50 shown in FIGS. 18A-18C includes two pillow halves 56 that are hinged together with a strip of fabric 52, in FIG. 18B. In FIG. 19, each pillow half 56 has lofty stuffing 58 that is not typical of pillow stuffing. The lofty stuffing 58 is typically used in blankets and is rolled up and stuffed into each half 56, as illustrated in FIG. 19. The two pillow halves 56 create a clumping resistant stuffing that will stand up to numerous washings. In FIG. 20, each pillow 50 includes a tacking 54 to further prevent clumping by stabilizing the lofty stuffing within the pillow 50. The bi-fold pillow 50 provides a pillow 50 that has compartmentalized the lofty stuffing 58 thus giving the lofty stuffing 58 a stabilizing property that will resist clumping when laundered, yet be thin enough to fit in most standard size washing machines. Folding the two halves 56 together creates a pillow 50 that is the thickness of typical pillows. One use of the bi-fold pillow 50 could be in psychiatric institutions that require frequent washings of pillows for infection control. This bi-fold pillow 50 would be a replacement to typical vinyl covered pillows found in hospitals and institutions. Vinyl covered pillows have been used by psychiatric patients for self-harm by asphyxiation, by creating an opening and wrapping the vinyl covering over their head.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An anti-ligative bed linen system for a mattress, comprising:

a bed linen having a blanket and a cover;

the blanket having a top side, a bottom side;

the cover configured to fit on the mattress and having an outside surface and an inside surface;

a lower portion of the bottom side of the blanket is secured to an end portion of the outside surface of the cover creating a secured union between the blanket and cover, the union is configured to lie under the mattress when the anti-ligative bed linen is placed on the mattress;

a main portion of the blanket is not secured to the cover and is available to be used for warmth when the anti-ligative bed linen is placed on the mattress;

the lower portion of the blanket includes an extended flap having a width narrower than the width of the main portion of the blanket;

a lower part of the extended flap is secured via the bottom side to the end portion of the outside surface of the cover creating the secured union between the blanket and cover; and an upper part of the extended flap is not secured to the cover and extends approximately up to a top surface of the mattress when the anti-ligative bed linen is placed on the mattress allowing the main portion of the blanket to drape over the side edges of the mattress.

2. The anti-ligative bed linen system of claim 1 wherein the bed linen is made of a material having a thickness that hinders persons from rolling the bed linen to use as a ligature to commit suicide.

3. The anti-ligative bed linen system of claim 2 wherein the bed linen is made of a material having a strength that hinders persons from tearing the bed linen to use as a ligature to commit suicide.

4. The anti-ligative bed linen system of claim 2 wherein the bed linen is made of a quilted material.

5. The anti-ligative bed linen system of claim 3 wherein the bed linen is made of quilted material.

6. The anti-ligative bed linen system of claim 1 wherein the union is configured to lie under the mattress allowing a plurality of bed linens to be placed onto the mattress.

7. The anti-ligative bed linen system of claim 1 further including an alarm system that warns when the bed linen has been removed from the mattress.

8. The anti-ligative bed linen system of claim 7 wherein the alarm system includes a sensor material incorporated into at least one section of the cover;

a sensor placed proximate the mattress senses when the sensor material is in close proximity to the sensor;

a circuit in communication with the sensor; and an alarm in communication with the circuit, the circuit actuates the alarm when the sensor indicates to the circuit that the sensor material is no longer in close proximity to the sensor indicating the bed linen is being removed from the mattress.

9. The anti-ligative bed linen system of claim 8 further including a setting switch in communication with the circuit that activates and deactivates the alarm system.

10. The anti-ligative bed linen system of claim 8 wherein the sensor material in each section is configured to be under the mattress when the cover is placed on the mattress.

11. The anti-ligative bed linen system of claim 10 wherein the sensor is attached to a bed platform located underneath the mattress.

12. The anti-ligative bed linen system of claim 8 wherein the sensor material is a metalized material.

13. The anti-ligative bed linen system of claim 8 wherein the alarm includes a visual warning indicator.

14. The anti-ligative bed linen system of claim 8 wherein the alarm includes an audio warning indicator.

15. The anti-ligative bed linen system of claim 1 further including a washable bi-fold quilted pillow.

16. An anti-ligative bed linen system for a mattress, comprising:

a bed linen having a blanket and a cover;

the blanket having a top side, a bottom side;

the cover configured to fit on the mattress and having an outside surface and an inside surface;

a lower portion of the bottom side of the blanket is secured to an end portion of the outside surface of the cover creating a secured union between the blanket and cover, the union is configured to lie under the mattress when the anti-ligative bed linen is placed on the mattress;

a main portion of the blanket is not secured to the cover and is available to be used for warmth when the anti-ligative bed linen is placed on the mattress;

the lower portion of the blanket includes an extended flap having a width narrower than the width of the main portion of the blanket;

a lower part of the extended flap is secured via the bottom side to the end portion of the outside surface of the cover creating the secured union between the blanket and cover; and an upper part of the extended flap is not secured to the cover and extends approximately up to a top surface of the mattress when the anti-ligative bed linen is placed on the mattress allowing the main portion of the blanket to drape over the side edges of the mattress;

the union is configured to lie under the mattress allowing a plurality of bed linens to be placed onto the mattress.

17. The anti-ligative bed linen system of claim 16 wherein the bed linen is made of a material having a thickness that hinders persons from rolling the bed linen to use as a ligature to commit suicide.

18. The anti-ligative bed linen system of claim 16 wherein the bed linen is made of a material having a strength that hinders persons from tearing the bed linen to use as a ligature to commit suicide.

19. The anti-ligative bed linen system of claim 16 wherein the bed linen is made of a quilted material.

20. The anti-ligative bed linen system of claim 16 further including an alarm system that warns when the bed linen has been removed from the mattress.

21. The anti-ligative bed linen system of claim 20 wherein the alarm system includes a sensor material incorporated into at least one section of the cover;

a sensor placed proximate the mattress senses when the sensor material is in close proximity to the sensor;

a circuit in communication with the sensor; and an alarm in communication with the circuit, the circuit actuates the alarm when the sensor indicates to the circuit that the sensor material is no longer in close proximity to the sensor indicating the bed linen is being removed from the mattress.

22. The anti-ligative bed linen system of claim 21 further including a setting switch in communication with the circuit that activates and deactivates the alarm system.

23. The anti-ligative bed linen system of claim 21 wherein the sensor material in each section is configured to be under the mattress when the cover is placed on the mattress.

24. The anti-ligative bed linen system of claim 23 wherein the sensor is attached to a bed platform located underneath the mattress.

25. The anti-ligative bed linen system of claim 21 wherein the sensor material is a metalized material.

26. The anti-ligative bed linen system of claim 21 wherein the alarm includes a visual warning indicator.

27. The anti-ligative bed linen system of claim 21 wherein the alarm includes an audio warning indicator.

28. An anti-ligative bed linen system for a mattress, comprising:

a bed linen having a blanket and a cover;

the blanket having a top side, a bottom side;

the cover configured to fit on the mattress and having an outside surface and an inside surface;

a lower portion of the bottom side of the blanket is secured to an end portion of the outside surface of the cover creating a secured union between the blanket and cover, the union is configured to lie under the mattress when the anti-ligative bed linen is placed on the mattress;

a main portion of the blanket is not secured to the cover and is available to be used for warmth when the anti-ligative bed linen is placed on the mattress;

the lower portion of the blanket includes an extended flap having a width narrower than the width of the main portion of the blanket;

the lower part of the extended flap is secured via the bottom side to the end portion of the outside surface of the cover creating the secured union between the blanket and cover;

an upper part of the extended flap is not secured to the cover and extends approximately up to a top surface of the mattress when the anti-ligative bed linen is placed on the mattress allowing the main portion of the blanket to drape over the side edges of the mattress;

the union is configured to lie under the mattress allowing a plurality of bed linens to be placed onto the mattress;

the bed linen is made of a material having a thickness that hinders persons from rolling the bed linen to use as a ligature to commit suicide;

the bed linen is made of a material having a strength that hinders persons from tearing the bed linen to use as a ligature to commit suicide;

the bed linen is made of a quilted material;

an alarm system that warns when the bed linen has been removed from the mattress;

the alarm system includes a sensor material incorporated into at least one section of the cover;

a sensor placed proximate the mattress senses when the sensor material is in close proximity to the sensor;

a circuit in communication with the sensor;

an alarm in communication with the circuit, the circuit actuates the alarm when the sensor indicates to the circuit that the sensor material is no longer in close proximity to the sensor indicating the bed linen is being removed from the mattress;

a setting switch in communication with the circuit that activates and deactivates the alarm system;

the sensor material in each section is configured to be under the mattress when the cover is placed on the mattress;

the sensor is attached to a bed platform located underneath the mattress;

the sensor material is a metalized material;

the alarm includes a visual warning indicator;

the alarm includes an audio warning indicator.

* * * * *